US009469980B2

(12) United States Patent
Le et al.

(10) Patent No.: US 9,469,980 B2
(45) Date of Patent: Oct. 18, 2016

(54) CLICK FIT TOILET FLUSH HANDLE LEVER ASSEMBLY

(71) Applicant: FLUIDMASTER, INC., San Juan Capistrano, CA (US)

(72) Inventors: Tuan Le, Fountain Valley, CA (US); Venkat Mallela, San Marcos, CA (US); Can (Ken) Nguyen, Anaheim, CA (US)

(73) Assignee: FLUIDMASTER, INC., San Juan Capistrano, CA (US)

( * ) Notice: Subject to any disclaimer, the term of this patent is extended or adjusted under 35 U.S.C. 154(b) by 392 days.

(21) Appl. No.: 14/062,502

(22) Filed: Oct. 24, 2013

(65) Prior Publication Data

US 2014/0259342 A1 Sep. 18, 2014

Related U.S. Application Data

(60) Provisional application No. 61/793,740, filed on Mar. 15, 2013.

(51) Int. Cl.
*E03D 5/092* (2006.01)

(52) U.S. Cl.
CPC ..... *E03D 5/092* (2013.01)

(58) Field of Classification Search
CPC ..... E03D 5/092
USPC ..... 4/413, 414
See application file for complete search history.

(56) References Cited

U.S. PATENT DOCUMENTS

| | | | | |
|---|---|---|---|---|
| 2,358,471 | A | 9/1944 | Owens | |
| 2,580,531 | A * | 1/1952 | Driskill | E03D 5/092 4/401 |
| 4,575,881 | A | 3/1986 | Rozek | |
| 5,400,445 | A | 3/1995 | Hull | |
| 5,491,848 | A | 2/1996 | Wang | |
| 5,555,573 | A | 9/1996 | Jensen | |
| 5,611,091 | A | 3/1997 | Jensen | |
| 5,647,068 | A | 7/1997 | Jensen | |
| 5,933,878 | A | 8/1999 | Suehiro et al. | |
| 6,092,245 | A | 7/2000 | Jones | |
| 6,637,044 | B2 | 10/2003 | Rische et al. | |
| 6,643,855 | B1 | 11/2003 | Huang | |
| 7,596,819 | B2 | 10/2009 | Dutton et al. | |
| 7,861,330 | B2 | 1/2011 | Tau et al. | |
| 7,966,676 | B2 | 6/2011 | Ueno et al. | |
| 2005/0273919 | A1 | 12/2005 | Berlovan | |
| 2007/0151008 | A1 | 7/2007 | Hayashi et al. | |
| 2009/0307833 | A1 | 12/2009 | Ciski et al. | |
| 2010/0122405 | A1 | 5/2010 | Schuster | |
| 2012/0124727 | A1 | 5/2012 | Davis | |

FOREIGN PATENT DOCUMENTS

| | | |
|---|---|---|
| CN | 200820024988.5 | 4/2009 |

* cited by examiner

*Primary Examiner* — Tuan N Nguyen
(74) *Attorney, Agent, or Firm* — Gordon Rees Scully Mansukhani LLP

(57) ABSTRACT

A toilet lever assembly, including: (a) a sleeve dimensioned to pass through a toilet tank wall; (b) a rotatable post extending through the sleeve; (c) a toilet flush handle mounted to the end of the rotatable post that is positioned outside of the toilet tank; (d) a nut received onto the end of the sleeve that is positioned outside of the toilet tank; and (e) a lever housing mounted to the end of the post that is positioned inside of the toilet tank, the lever housing comprising: (i) an actuator for moving a toilet lever to cause a flush when the post is rotated, and (ii) a biasing mechanism for rotating the post back to a neutral position.

16 Claims, 10 Drawing Sheets

CLICK FIT TOILET FLUSH HANDLE LEVER ASSEMBLY

RELATED APPLICATION

The present invention claims priority to U.S. Provisional Patent Application 61/793,740, entitled CLICK-FIT LEVER, filed Mar. 15, 2013, the full disclosure of which is incorporated here by reference in its entirety.

TECHNICAL FIELD

The present invention relates to toilet flush levers.

BACKGROUND OF THE INVENTION

Toilet flush handle lever assemblies (as described herein) are the linkages from the flush handle on the outside of the toilet tank through to the lever that moves inside the tank. Such internal lever assemblies either pull up a chain to open a flapper valve or otherwise actuate a flush valve mechanism to cause the toilet to flush. These assemblies translate the physical act of pushing a lever on the side of the toilet tank into the flushing of the toilet bowl.

Unfortunately, many current designs tend to use large, bulky components positioned within the toilet tank. As these components require space to rotate, they are difficult to position and do not fit all toilet geometries. What is instead desired is a toilet flush lever assembly that occupies a minimal amount of space within the toilet tank, and can therefore be retrofit into many different geometries of existing toilet tanks. Ideally, such a device would be able to be easily retrofit onto toilet tanks having flush handles on either side of the tank. Additionally, such a retrofit should be very easy for an end user to operate.

SUMMARY OF THE INVENTION

The present invention provides a compact toilet flush lever assembly that operates in a small space within the toilet tank. As a result, the present toilet flush lever assembly can easily be retro-fit into many existing toilet tanks. Moreover, its flush handle that can be easily and quickly "click snapped" onto position. Preferably, this click fitting is audible such that an end user can easily be sure the installation is correct. In preferred embodiments, a biasing mechanism returns the flush handle to a neutral position by rotating the handle in the opposite direction to which it has been pushed to cause the flush. Preferably, rotation to cause the flush can be done in both directions As a result, the present device can be mounted in the flush handle opening on either the left or right side of the toilet tank. Thus, it can be readily used with either left or right handed toilets.

In one preferred aspect, the present invention provides a toilet lever assembly, comprising: (a) a sleeve dimensioned to pass through a toilet tank wall; (b) a rotatable post extending through the sleeve; (c) a toilet flush handle mounted to the end of the rotatable post that is positioned outside of the toilet tank; (d) a nut received onto the end of the sleeve that is positioned outside of the toilet tank; and (e) a lever housing mounted to the end of the post that is positioned inside of the toilet tank, the lever housing comprising: (i) an actuator for moving a toilet lever to cause a flush when the post is rotated, and (ii) a biasing mechanism for rotating the post back to a neutral position.

In preferred aspects, the nut is positioned outside of the tank within a toilet flush handle hub. This advantageously saves space within the toilet tank, and hides the nut so it cannot be seen from the outside of the tank.

Preferably, the lever housing comprises a non-rotatable portion and a rotatable portion, with a spring therebetween that urges the rotatable portion (and the rotatable post) to return to a neutral position after the flush.

Optionally, the actuator of the lever housing comprises: (i) a short arm extending from the rotatable portion of the lever housing; and (ii) a lever arm extending from an end of the short arm, wherein the lever arm is rotatable around an end of the short arm.

DETAILED DESCRIPTION OF THE DRAWINGS

Figure 1A:
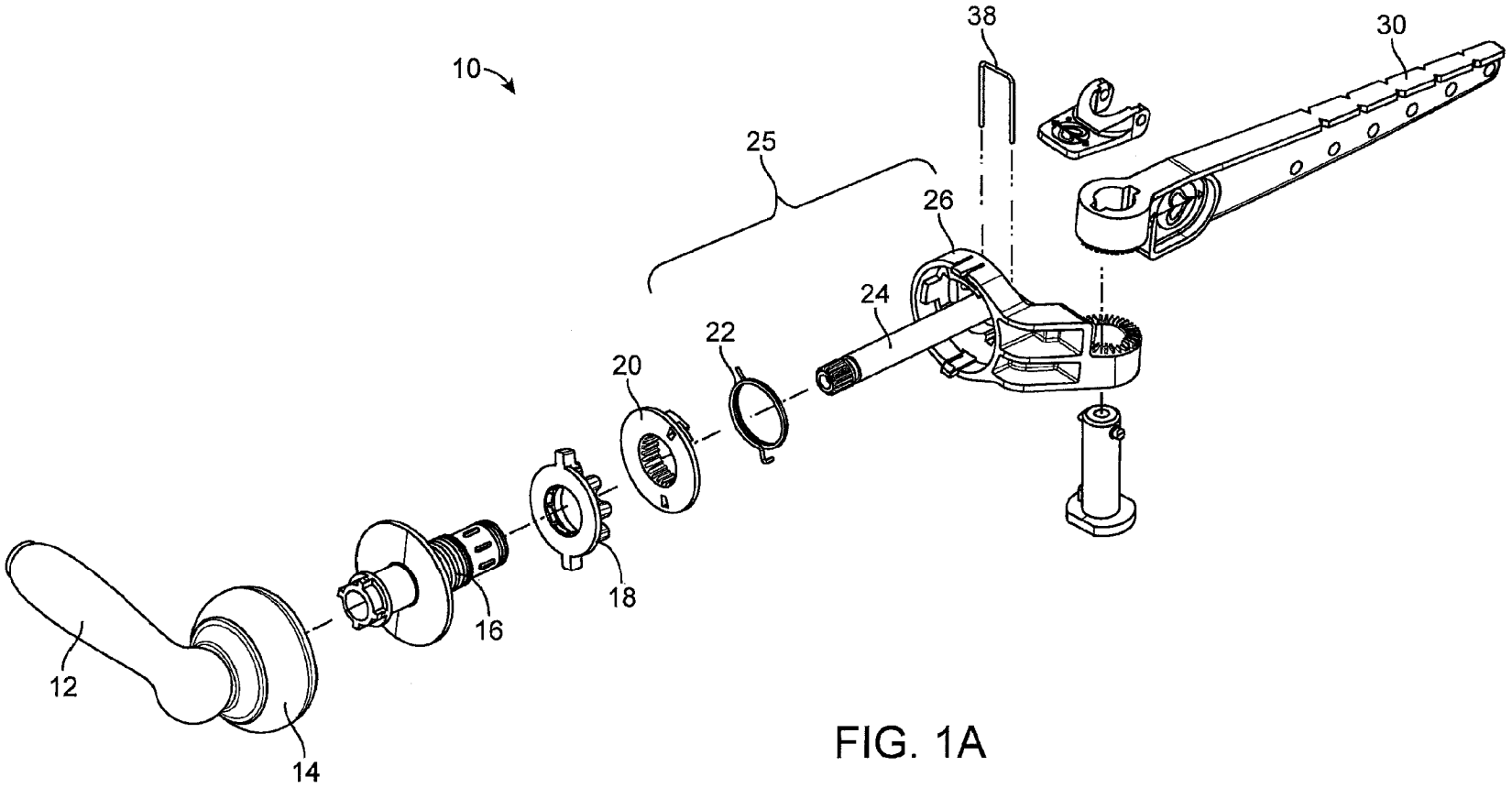
FIG. 1A is an exploded perspective view of the present assembly from one direction.
Figure 1B:
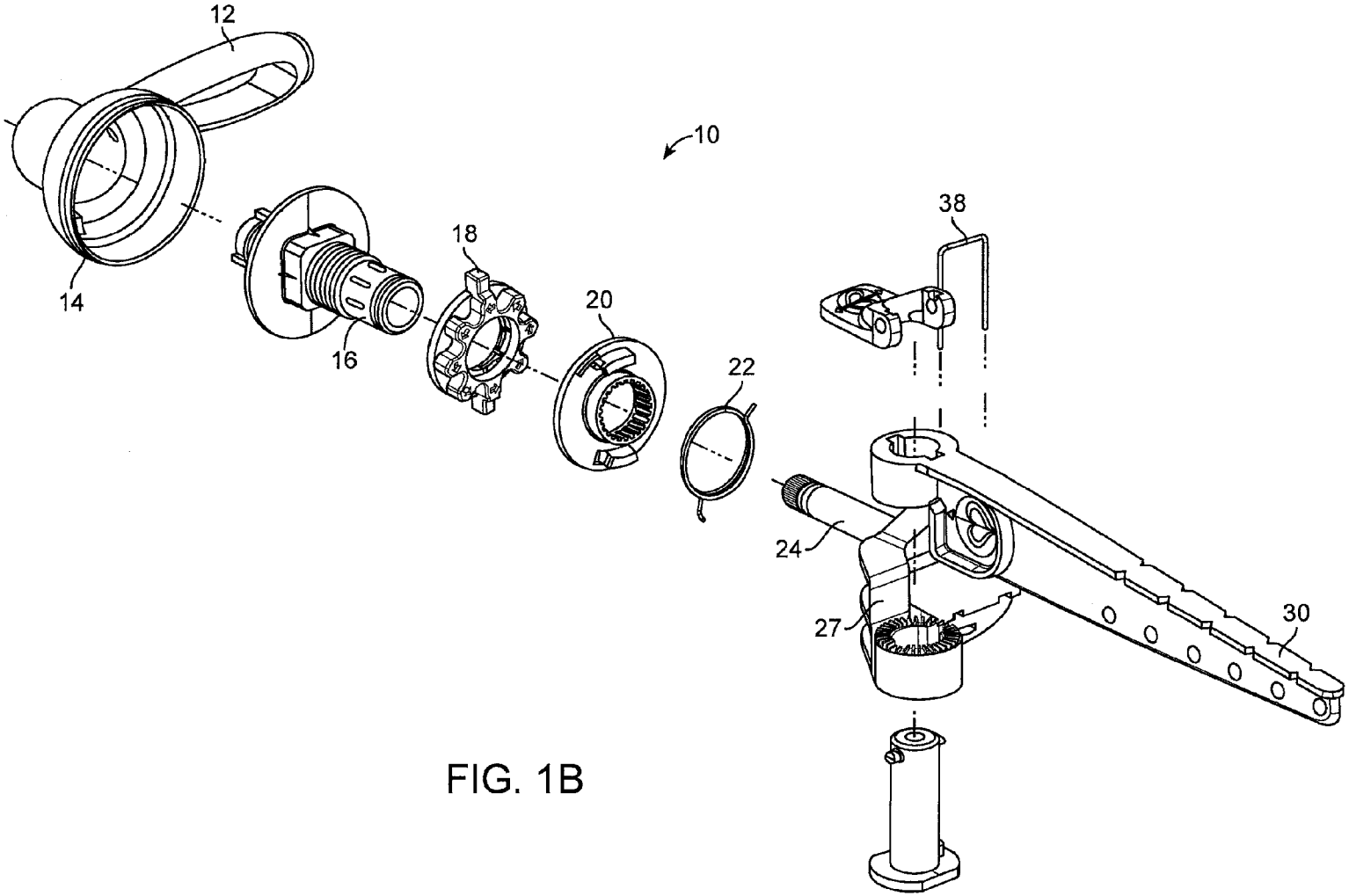
FIG. 1B is an exploded perspective view of the present assembly, from an opposite direction.
Figure 2:
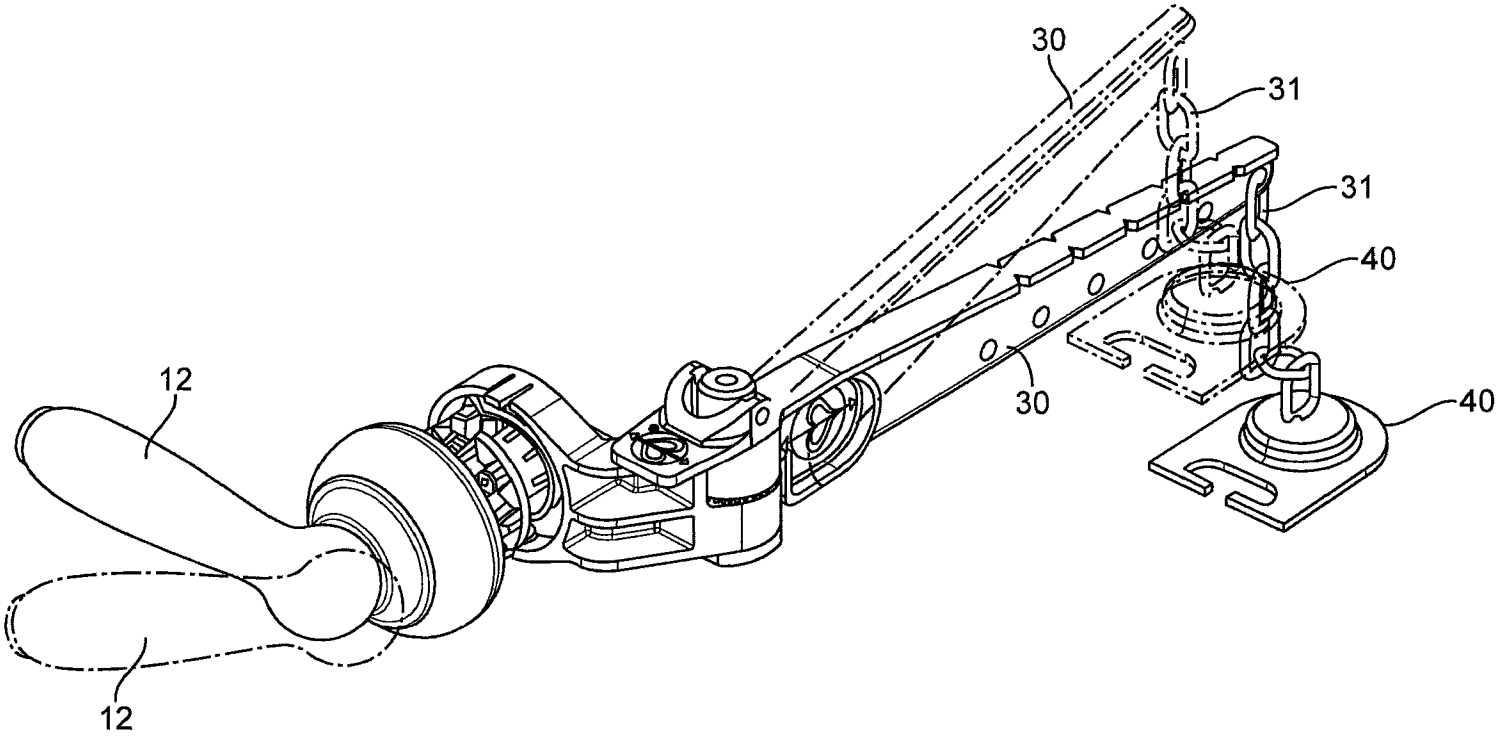
FIG. 2 is a perspective view of the present assembly showing movement of the system components during operation.

FIGS. 1A and 1B are exploded perspective views of the present assembly taken from opposite directions. FIG. 2 is a perspective view showing movement of the present components during flushing operation.

Specifically, assembly 10 comprises a handle 12, a handle hub 14, a sleeve 16, a nut 18, a spring housing 20, a spring 22, a rotatable post 24, a lever mount 26, a short arm 27 and a lever 30. The lever housing 25 thus includes a rotatable portion (being lever mount 26) and a non-rotatable portion (being spring housing 20). Sleeve 16 passes through the wall of the toilet tank. Components 12, 14 and 18 are all disposed outside of the toilet tank. Components 20 to 40 are all disposed within the toilet tank.

In accordance with the method of the present invention, handle 12 rotates post 24 which in turn rotates lever mount 26. As lever mount 26 rotates about the axis of post 24, the distal end of lever arm 30 is moved up and down (such that a chain or cord 31 attached thereto can lift open a flapper valve 40 in the tank, causing the tank to flush. This is seen in FIG. 2 when a user pushes down on handle 12 (i.e.: moving it to the dotted line position), post 24 will be rotated such that it is lifted (i.e.: moving it to its own the dotted line position). Sleeve 16 remains stationary. Therefore, the movement of lever mount 26, short arm 27 and lever 30 together acts as the actuator portion of the lever housing 25. Preferably, lever arm 30 is rotatable such that it pivots around an end of short arm 27.

Spring 22 is received into spring housing 20 (which also remains stationary). As handle 12 is rotated, post 24 rotates. This tightens spring 22. Spring 22 thus resists the rotation of post 24. As a result, when the operator releases handle 12 after a flush, spring 22 will both simultaneously rotate handle 12 and lever mount 26 back into their pre-flush positions.

The benefit of using spring 22 as an anti-rotation mechanism is that it pops lever arm 30 quickly back into its pre-flush position without having to rely on gravity. Thus, there is no need to build a heavy counterweight into housing 30 to rotate lever 30 back down into its pre-flush position (i.e.: there is no need for a weight added to short arm 27). This in turn minimizes the size of the lever mount 26 (resulting in a smaller lever housing 25 with less or smaller components in the tank where space is at a premium).

Figure 3:
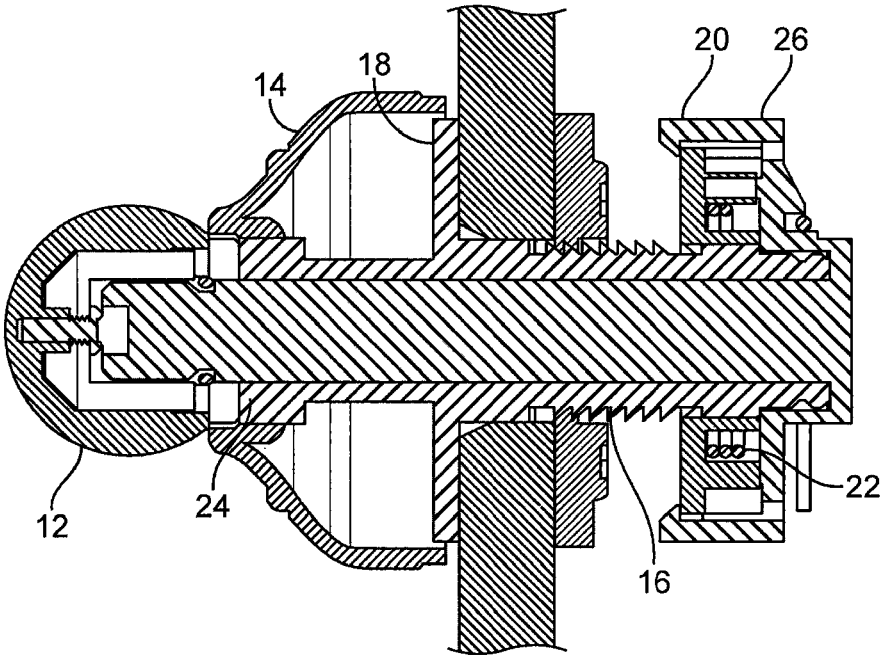
FIG. 3 is a sectional elevation view of a first embodiment of the invention.

FIG. 3 illustrates details of a first embodiment of the invention showing that nut 18 is positioned outside of the tank (as is covered by handle hub 14). This advantageously increases the amount of space within the tank, and therefore allows lever mount 26 to be mounted closer to the inside surface of the tank. Moreover, placing nut 18 within handle hub 14 results in a system where nut 18 does not increase the overall length of the assembly.

Figure 4A:
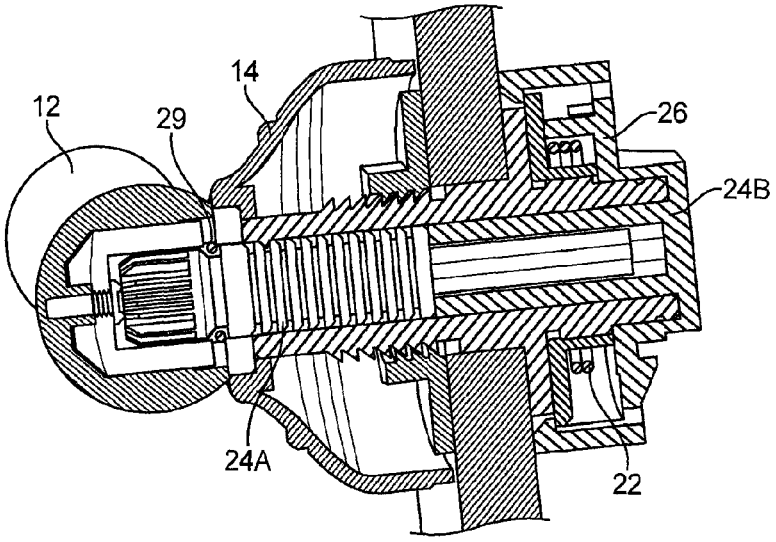
FIG. 4A is a sectional elevation view of a second embodiment of the invention installed on a narrow walled toilet tank.
Figure 4B:
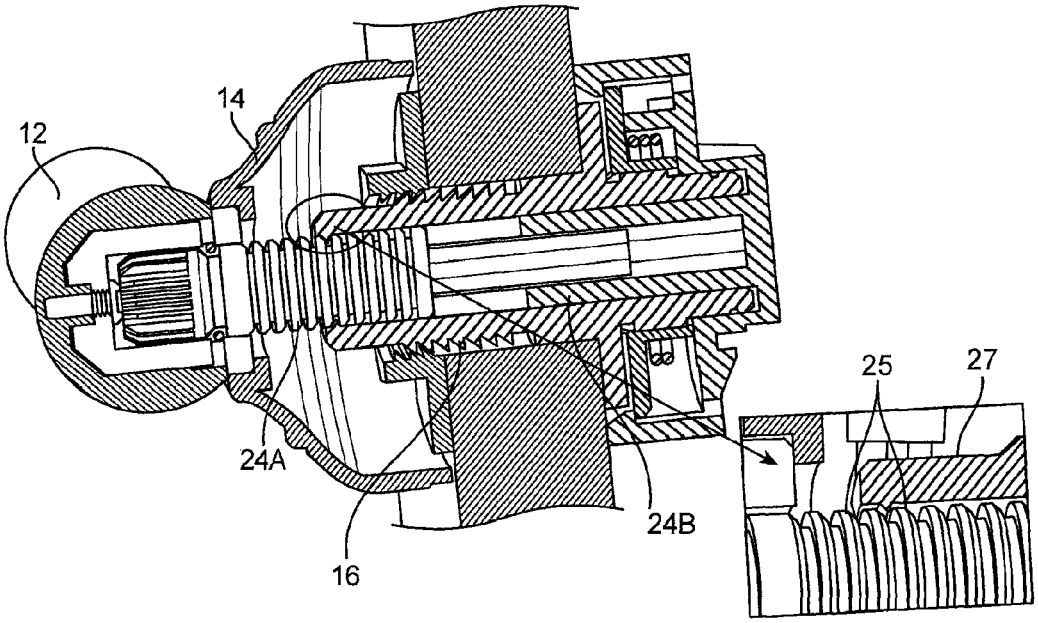
FIG. 4B is a sectional elevation view of a second embodiment of the invention installed on a thick walled toilet tank.
Figure 5:
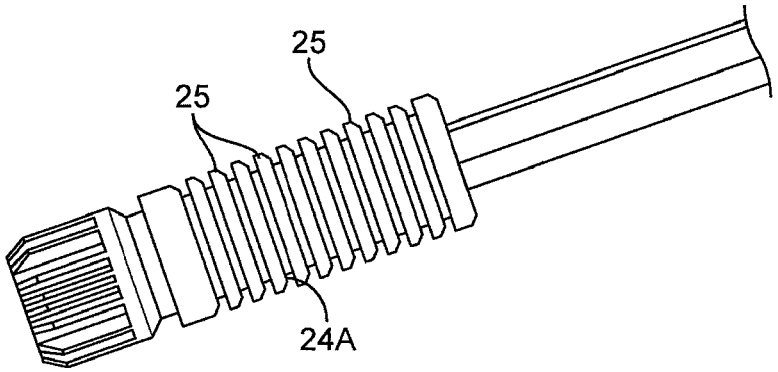
FIG. 5 is a perspective view of the first post section of the second embodiment of the rotatable post.
Figure 6:
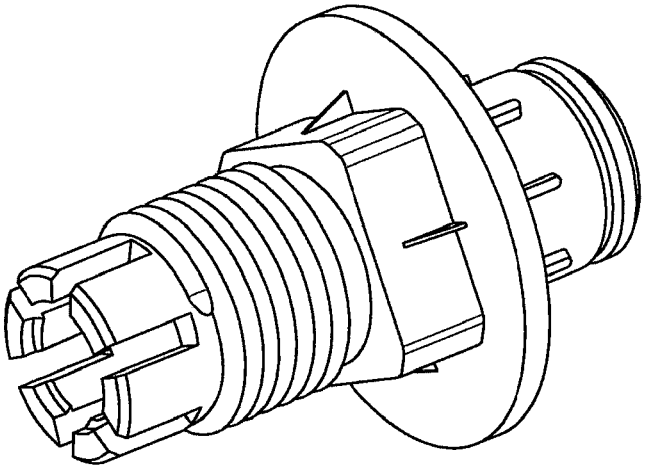
FIG. 6 is a perspective view of the sleeve, showing the notches for securing the first portion of the rotatable post.

FIGS. 4A and 4B illustrate a second embodiment of the invention that it is adjustable to different thicknesses of toilet walls, as follows: Post 24 is now a two part post, having an inner section 24A and an outer section 24B. Section 24A slides within section 24B to vary the overall length of post 24. This advantageously accommodates both thin walled or thick walled toilet tanks. Section 24A has ribs 25 thereon and the end of sleeve 16 has a notch 27 such that when section 24A is pushed down into section 24B, it will slide into the position at which notch 27 snaps into its final position between two ribs 25, thereby holding sections 24A and 24B together within sleeve 16. FIG. 5 is a perspective view of the inner post section 24A of the second embodiment of rotatable post 24. FIG. 6 is a perspective view of sleeve 16, showing notches 27 for securing the first portion 24A of the rotatable post and the second portion 24B of the rotatable post together.

Figure 7A:
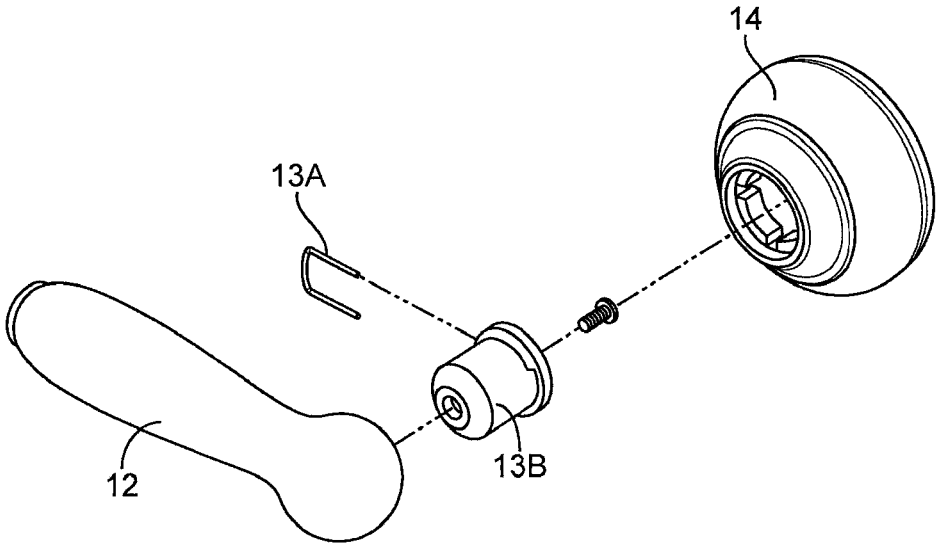
FIG. 7A is an exploded perspective view of the mechanism in the flush handle that click fits onto the end of the rotatable post.
Figure 7B:
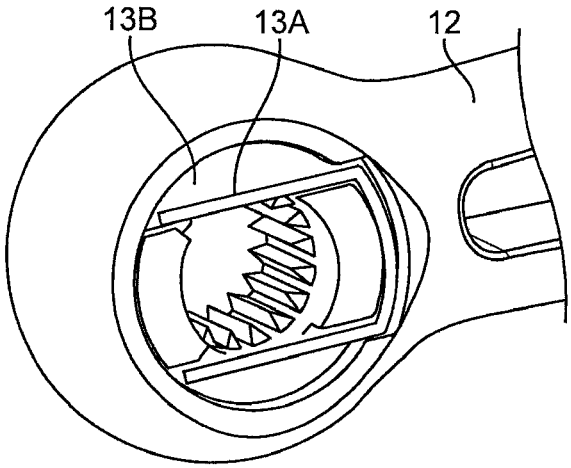
FIG. 7B in another exploded perspective view of the click fit mechanism in the flush handle from an opposite direction.

FIGS. 7A and 7B illustrate further optional details of how the toilet flush handle 12 is "click-fit" mounted to the end of rotatable post 24 that is positioned outside of the toilet tank. Specifically, toilet flush handle 12 includes an expandable clip 13A that is received into an insert 13B which is in turn received into the flush handle 12. In operation, clip 13A deforms outwardly to pass over the end of rotatable post 24 and is then received ("snapped") into a groove 29 on the rotatable post. As a result, toilet flush handle 12 can be click-fit onto rotatable post 24. Preferably, toilet flush handle 12 produces an audible clicking sound when it is click-fit onto the end of rotatable post 24.

Figure 8A:
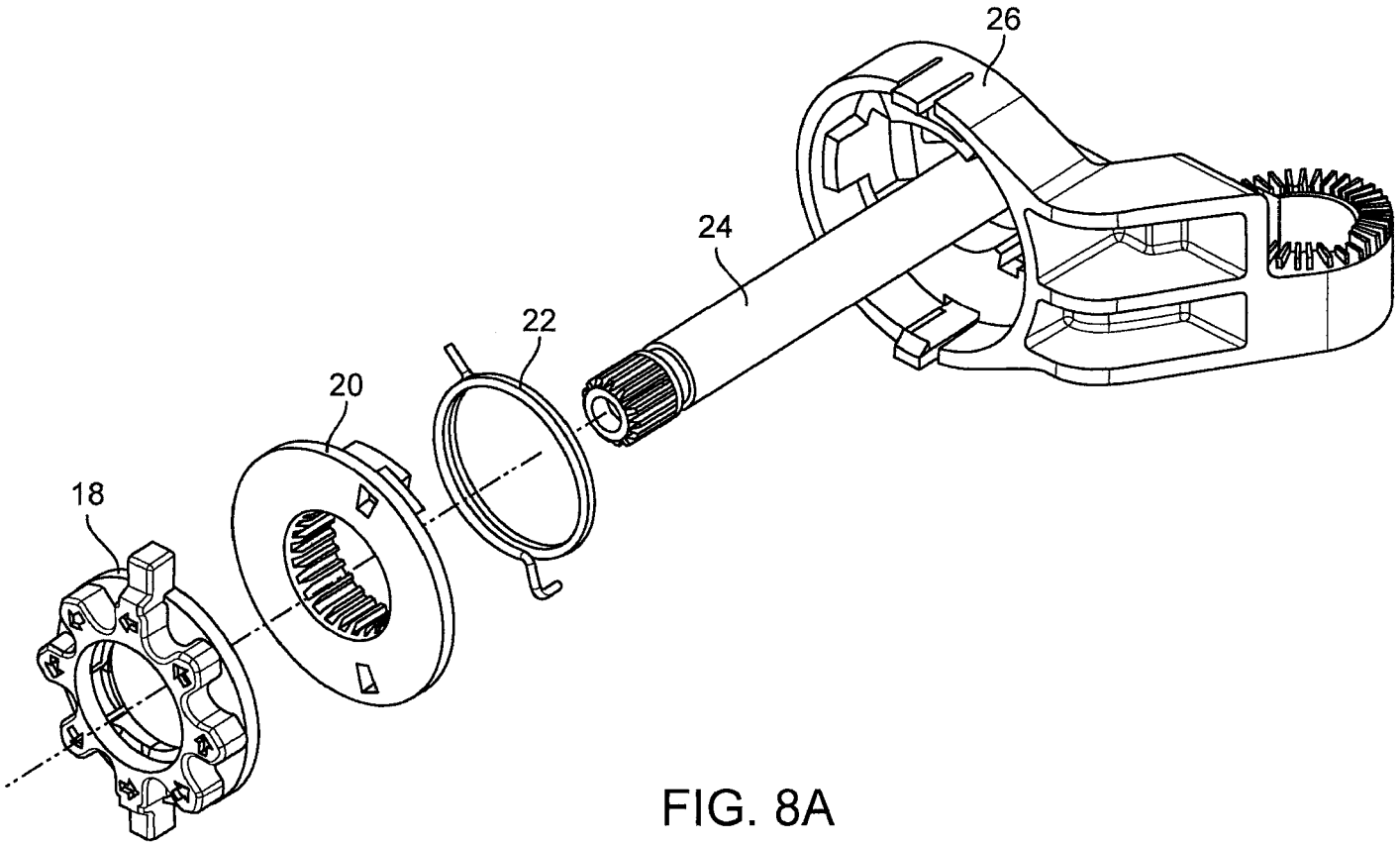
FIG. 8A is an exploded perspective view of the components of the lever housing.
Figure 8B:
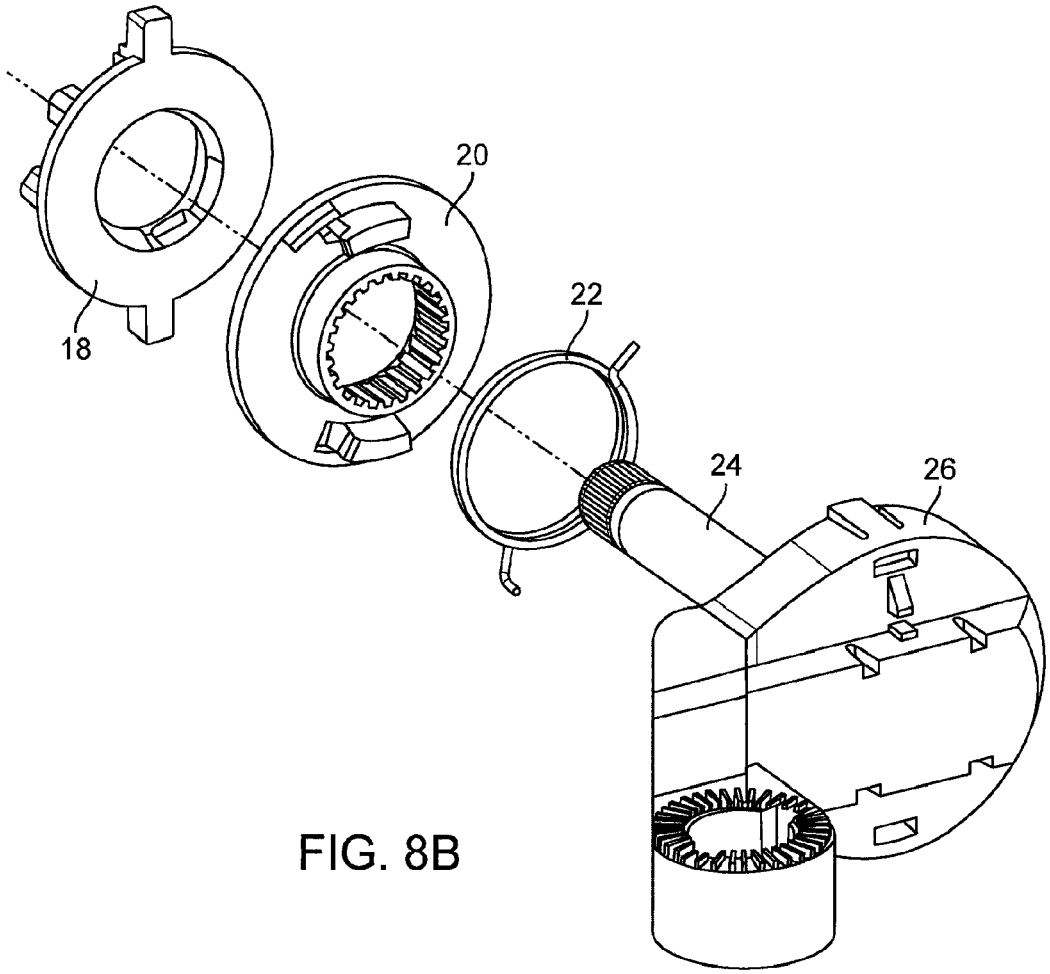
FIG. 8B is another exploded perspective view of the components of the lever housing from an opposite direction.

FIGS. 8A and 8B illustrate further optional details of the workings of the components in lever housing 25. Lever housing 25 comprises a non-rotatable portion (spring mount 20) and a rotatable portion lever mount 26). The rotatable portion (spring mount 26) rotates together with rotatable post 24 and handle 12. The non-rotatable portions (spring mount 20 and nut 18) are positioned against the inside and outside wall surfaces of the toilet tank. Spring 22 is positioned in spring housing 20 with one end against an internal surface of spring housing 20, and an opposite end against lever mount 26. (Spring housing 20 is received into lever mount 26.

In operation, spring 22 moves the rotatable portion of the housing with respect to the non-rotatable portion of the housing to rotate the post back to the neutral position. In preferred embodiments, spring 22 rotates post 24 back to the neutral position from either direction. Therefore, the present invention can be used on either a left or right handed toilet (i.e.: a toilet with the flush handle on either the left or right side of the tank).

Also in preferred embodiments, the rotatable portion 26 of lever housing 25 is mounted to the end of post 24 by a clip 38 that is received into a groove on the rotatable post.

Figure 9:
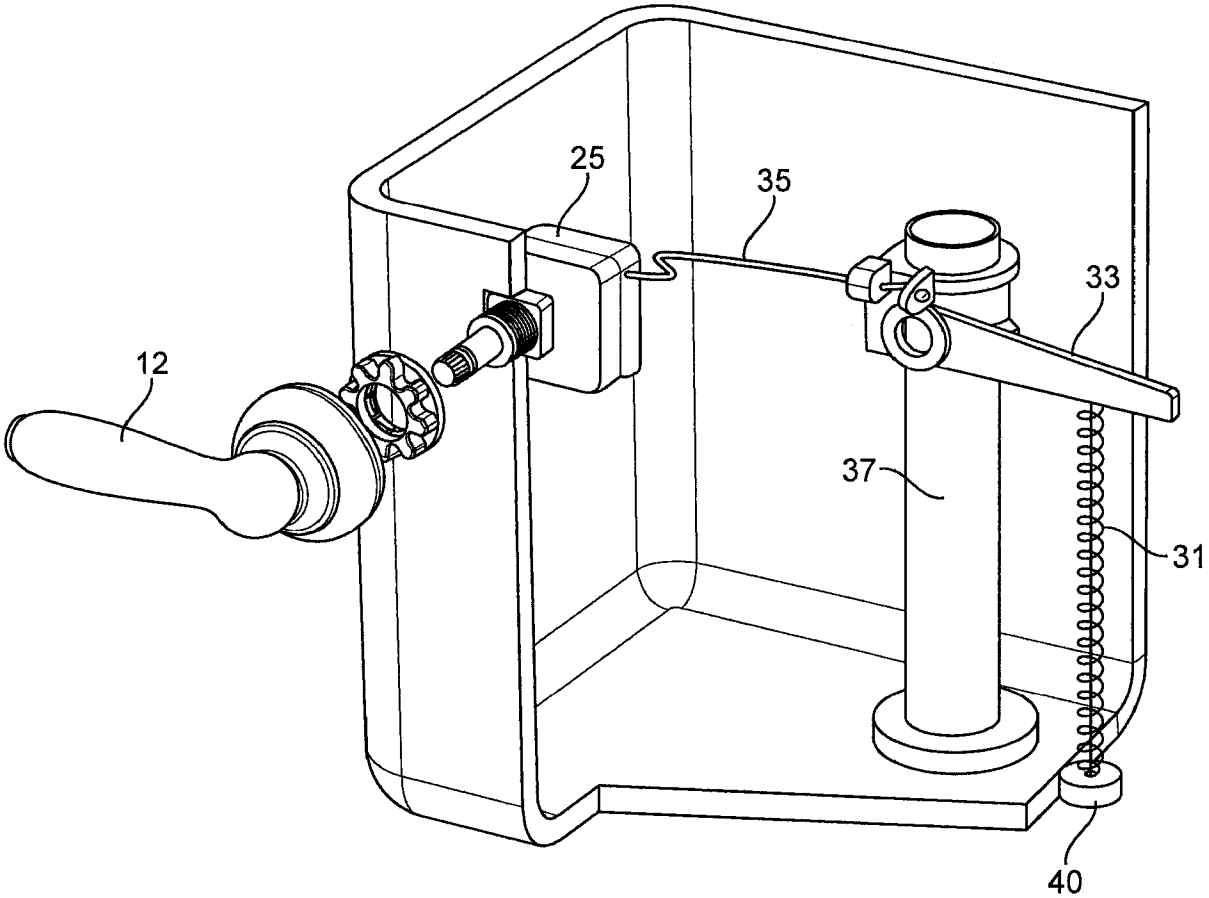
FIG. 9 is a perspective view of a third embodiment of the present invention.

Lastly, FIG. 9 is a perspective view of another embodiment of the present invention in which lever housing 25 instead comprises a cable 35 extending a lever arm 33 mounted on an overflow tube 37. In operation, cable 35 lifts lever arm 33 when handle 12 is pushed down. As a result, chain 31 lifts flapper 40, causing a flush.

What is claimed is:

1. A toilet lever assembly, comprising:
- (a) a sleeve dimensioned to pass through a toilet tank wall;
- (b) a rotatable post extending through the sleeve;
- (c) a toilet flush handle detachably mounted to an end of the rotatable post; and
- (d) a lever housing mounted to an end of the rotatable post that is positioned inside of the toilet tank, the lever housing comprising:
  - (i) an actuator for moving a toilet lever to cause a flush when the post is rotated, wherein the actuator comprises:
    - a short arm extending outwardly from the lever housing, the short arm being rotatable about a horizontal axis, and
    - a lever arm extending from an end of the short arm, the lever arm being rotatable about a vertical axis that is substantially perpendicular to the rotatable post, and
  - (ii) a biasing mechanism for rotating the post back to a neutral position.

2. The toilet lever assembly of claim 1, wherein a nut is positioned within a toilet flush handle hub.

3. The toilet lever assembly of claim 1, wherein the toilet flush handle is click-fit onto the rotatable post.

4. The toilet lever assembly of claim 3, wherein the toilet flush handle produces an audible sound when the toilet flush handle is click-fit onto the rotatable post.

5. The toilet lever assembly of claim 3, wherein the toilet flush handle comprises an expandable clip that deforms to pass over the end of the rotatable post and is received into a groove on the rotatable post.

6. The toilet lever assembly of claim 1, wherein the biasing mechanism rotates the post back to the neutral position from either direction.

7. The toilet lever assembly of claim 1, wherein the rotatable post comprises a first post section slidably receivable within a second post section such that the length of the post can be adjusted to accommodate the thickness of a toilet tank wall.

8. The toilet lever assembly of claim 7, wherein the first post section is detachably secured to the second post section.

9. The toilet lever assembly of claim 1, wherein the lever housing comprises a non-rotatable portion and a rotatable portion, and wherein the rotatable portion of the lever housing rotates together with the rotatable post.

10. The toilet lever assembly of claim 9, wherein the biasing mechanism moves the rotatable portion of the lever housing with respect to the non-rotatable portion of the lever housing to rotate the post back to the neutral position.

11. The toilet lever assembly of claim 10, wherein the biasing mechanism is a spring mounted between the rotatable and non-rotatable portions of the lever housing.

12. The toilet lever of claim 1, wherein the lever is detachably secured to the end of the post.

13. The toilet lever of claim 1, wherein the actuator further comprises an adjustable cam connecting the lever arm to the short arm.

14. A toilet lever assembly, comprising:

(a) a sleeve dimensioned to pass through a toilet tank wall;

(b) a rotatable post extending through the sleeve;

(c) a toilet flush handle mounted at an end of the rotatable post outside of the toilet tank; and (d) a lever housing mounted to an end of the rotatable post that is positioned inside of the toilet tank, the lever housing comprising:

(i) an actuator for moving a toilet lever to cause a flush when the post is rotated, wherein the actuator comprises:

a short arm extending outwardly from a lever housing, the short arm being rotatable about a first axis, and a lever arm extending from an end of the short arm, the lever arm being rotatable about a second axis that is substantially perpendicular to the first axis, and wherein the first and second axes do not intersect; and (ii) a biasing mechanism for rotating the post back to a neutral position.

15. The toilet lever assembly of claim 14, wherein the toilet flush handle is click-fit onto the rotatable post.

16. The toilet lever assembly of claim 14, wherein the biasing mechanism rotates the post back to the neutral position from either direction.

* * * * *